US009346311B2

(12) United States Patent
Leonard et al.

(10) Patent No.: US 9,346,311 B2
(45) Date of Patent: May 24, 2016

(54) HIGH CAPACITY POCKET FILE FOLDER

(71) Applicant: Smead Manufacturing Company, Hastings, MN (US)

(72) Inventors: Michael D. Leonard, Woodbury, MN (US); Scott Leonard, Excelsior, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 14/803,915

(22) Filed: Jul. 20, 2015

(65) Prior Publication Data

US 2015/0321500 A1 Nov. 12, 2015

Related U.S. Application Data

(63) Continuation of application No. 14/536,861, filed on Nov. 10, 2014, now abandoned, and a continuation of application No. 13/484,717, filed on May 31, 2012, now abandoned.

(51) Int. Cl.

| | |
|---|---|
| ***B31B 1/14*** | (2006.01) |
| ***B31B 49/00*** | (2006.01) |
| ***B31F 5/02*** | (2006.01) |
| ***B31F 7/00*** | (2006.01) |
| ***B42D 3/04*** | (2006.01) |
| ***B42D 1/00*** | (2006.01) |
| ***B42D 3/00*** | (2006.01) |
| ***B65D 27/00*** | (2006.01) |
| ***B65D 37/00*** | (2006.01) |
| ***B42F 7/06*** | (2006.01) |
| ***B31B 1/20*** | (2006.01) |

(52) U.S. Cl.
CPC .... *B42F 7/06* (2013.01); *B31B 1/20* (2013.01)

(58) Field of Classification Search
CPC ..... B31B 1/20; B31B 19/14; B31B 19/16; B31B 19/20; B31B 37/00
USPC ..... 493/340, 352–356, 947; 281/7, 21.1, 281/31; 229/67.3, 67.4, 67.1
See application file for complete search history.

(56) References Cited

U.S. PATENT DOCUMENTS

| | | | | |
|---|---|---|---|---|
| 304,845 | A | 9/1884 | Moss | |
| 3,537,728 | A * | 11/1970 | Reese | B42F 19/00 150/147 |
| 3,858,790 | A | 1/1975 | Humphrey | |
| 4,301,962 | A | 11/1981 | Monckton et al. | |
| D312,275 | S | 11/1990 | Wyant | |
| 4,989,777 | A | 2/1991 | Miller | |
| D440,253 | S | 4/2001 | Wolff et al. | |

(Continued)

OTHER PUBLICATIONS

Folder sold in the market place by Marketing Arts, Inc., 5601 Zumbra Drive, Excelsior, MN 55331 USA, Jun. 2000.

*Primary Examiner* — Jes F Pascua
*Assistant Examiner* — Derek Battisti
(74) *Attorney, Agent, or Firm* — Altera Law Group, LLC

(57) ABSTRACT

A pocket folder with increased document capacity and method of manufacturing same is disclosed. The folder has two cover panels 14-16, joined along a longitudinal joint or score line, a pair of pocket flaps 40*a*-40*b* and a top flap 70. Top flap 70 folds along a score line 72*a*-72*b* and a midline score 74 and a plurality of parallel scores 78 to accommodate expansion. At the pockets, a v-shaped notch 52 between the pockets prevents bunching and a circular cut away 90*a*-90*b* provides greater access to the documents.

3 Claims, 5 Drawing Sheets

(56) References Cited

U.S. PATENT DOCUMENTS

| | | | | |
|---|---|---|---|---|
| 6,382,864 | B1 | 5/2002 | Moor | |
| 6,453,589 | B1 | 9/2002 | Schwartz | |
| 6,578,756 | B2 | 6/2003 | Marumi | |
| 6,659,336 | B2 * | 12/2003 | Brennan | B42F 17/24 206/425 |
| 7,108,169 | B2 | 9/2006 | Balzer | |
| 8,162,204 | B2 | 4/2012 | Makofsky | |
| 2003/0010815 | A1 | 1/2003 | Balzer | |
| 2003/0084846 | A1 * | 5/2003 | Guzzon | B31B 1/62 118/679 |
| 2003/0144121 | A1 * | 7/2003 | Walsh | B31B 3/00 493/51 |
| 2004/0066031 | A1 | 4/2004 | Wong et al. | |
| 2004/0245324 | A1 | 12/2004 | Chen | |
| 2005/0127148 | A1 | 6/2005 | Gecha | |
| 2005/0156017 | A1 | 7/2005 | Crum et al. | |
| 2005/0242566 | A1 * | 11/2005 | Cordes | B42F 7/02 281/29 |
| 2006/0055167 | A1 | 3/2006 | Pollman et al. | |
| 2006/0081689 | A1 * | 4/2006 | Sierra | B42F 7/04 229/67.1 |
| 2006/0202002 | A1 | 9/2006 | Retucci | |
| 2008/0156853 | A1 * | 7/2008 | Dodson | B42F 15/0035 229/67.1 |
| 2008/0197174 | A1 | 8/2008 | Wittmeyer et al. | |
| 2008/0257940 | A1 | 10/2008 | Busam et al. | |
| 2009/0114704 | A1 | 5/2009 | Howlett | |
| 2011/0084119 | A1 | 4/2011 | Zapalac | |

* cited by examiner

HIGH CAPACITY POCKET FILE FOLDER

CROSS-REFERENCE TO RELATED APPLICATION

This is a continuation of patent application Ser. No. 14/536,861 filed on Nov. 10, 2014 which is a continuation of patent application Ser. No. 13/484,717 filed 31 May 2012.

BACKGROUND

1. Field of the Disclosure

The present disclosure invention is directed to file folders and more particularly to pocket style file folders with the ability to handle a large number of documents.

2. Description of the Related Art

Pocket folders are typically characterized by having two leaves or side panels, joined longitudinally on a fold line and one or more of the panels having a pocket. One of the first examples of such a product is found in U.S. Pat. No. 304,845 to Moss (1884). A later embodiment is found in U.S. Design Pat. No. 312,275 to Wyant (1990). A further example is US Publication No. US2004/0066031 to Wong (2004).

Typically such pocket folders suffer from one of two problems (or both): 1) when the pockets are filled with too many sheets, they bulge and don't fold properly, thereby damaging the folder and often the papers and 2) if some accommodation has been made to problem 1 above, then the papers in the pockets may fall out easily because the accommodation disturbs the viability of the pocket feature.

The present disclosure addresses both of these problems with an innovative solution.

BRIEF SUMMARY OF THE INVENTION

The following summary is intended to assist the reader in understanding the full disclosure and the claims. The claims define the scope of the invention, not this summary.

The disclosure includes a document holder having a first cover and a second cover, having upper, bottom, inner and outer peripheral edges joined together along their inner edges at a joint and defining a joint axis; each of said first cover and said second cover, each having an interior surface on the interior of the document holder and an outer surface on the exterior of the document holder; a pair of pockets formed of a pocket face attached to each of the covers at the bottom and outer edges and substantially unattached at its inner edge, said pocket face inner edge including a an angular shaped notch extending upwardly from its bottom edge at its inner edge and running upwardly, such as at a slight diagonal from the bottom edge joint axis intersection toward the upper edge away from the axis, the angular shaped notch of each pocket face together forming a v-shaped notch between the two, thereby creating a v-shaped gap.

The disclosure also includes a further retainer flap foldably attached at the upper edge of each cover, said flap spanning said covers but not being connected at the joint and, when in its unfolded state, forming an aperture bounded by the flap and the upper edges of the covers, said flap having a central fold line co-axially aligned with said joint axis and further including a plurality of parallel scored fold lines on either central fold line.

The disclosure also includes a semi-circular or circular concave cut away edge extending from the upper edge of the angular shaped notch on each pocket face to the upper edge of the pocket face, the semi-circular edges of the pocket faces together forming a generally have circle cut out formed between the pocket faces, with a v-shaped central base at the semicircle.

The disclosure also includes a retainer flap which is formed as a semi-circular element having a semi circular inner and outer peripheral edges.

The disclosure also includes a method of forming a blank for folding into a pocket folder by creating and scoring a blank sheet with the following, using some or all of these steps in any order:

A. cutting and scoring a blank having left and right edges and left and right portions and upper and lower edges and a central longitudinal score forming a center line and a lateral score line orthogonal to the central longitudinal score line located at a predetermined distance from the bottom of the blank;

B. cutting away a portion of the blank at its top edge orthogonal to the central score line, a semicircular flap protrusion, and defining an upper longitudinal edge of the blank, excluding the protrusion;

C. scoring said blank along the upper edge to define a fold line between the protrusion and the upper edge;

D. removing material between the protrusion and the upper edge to define an aperture, said aperture being generally symmetrical along the said fold line;

E. scoring a protrusion fold line in said protrusion, said protrusion fold line being co-axial with said blank fold line;

F. cutting a v-shaped notch into the bottom from at the central score line to said predetermined distance from the bottom;

G. folding along the said blank along said lateral score line to form a pair of side by side pockets;

H. folding said protrusion along said protrusion fold line to create a top retaining tab;

I. cutting away a section of the blank on the left and right portions adjacent to the bottom of the blank and side scoring the blank on the left and right portions longitudinally spaced at a predetermined distance from the left and right edges;

J. folding said blank along said at said side scoring;

K. affixing said side scoring portions to said pockets.

DETAILED DESCRIPTION OF THE DISCLOSURE

The present description shows pocket folder 10. It should be understood that the term pocket holder includes any form of document holder which has at least two faces, each having a pocket which are joined together by a central longitudinal fold line or joint.

Figure 1:
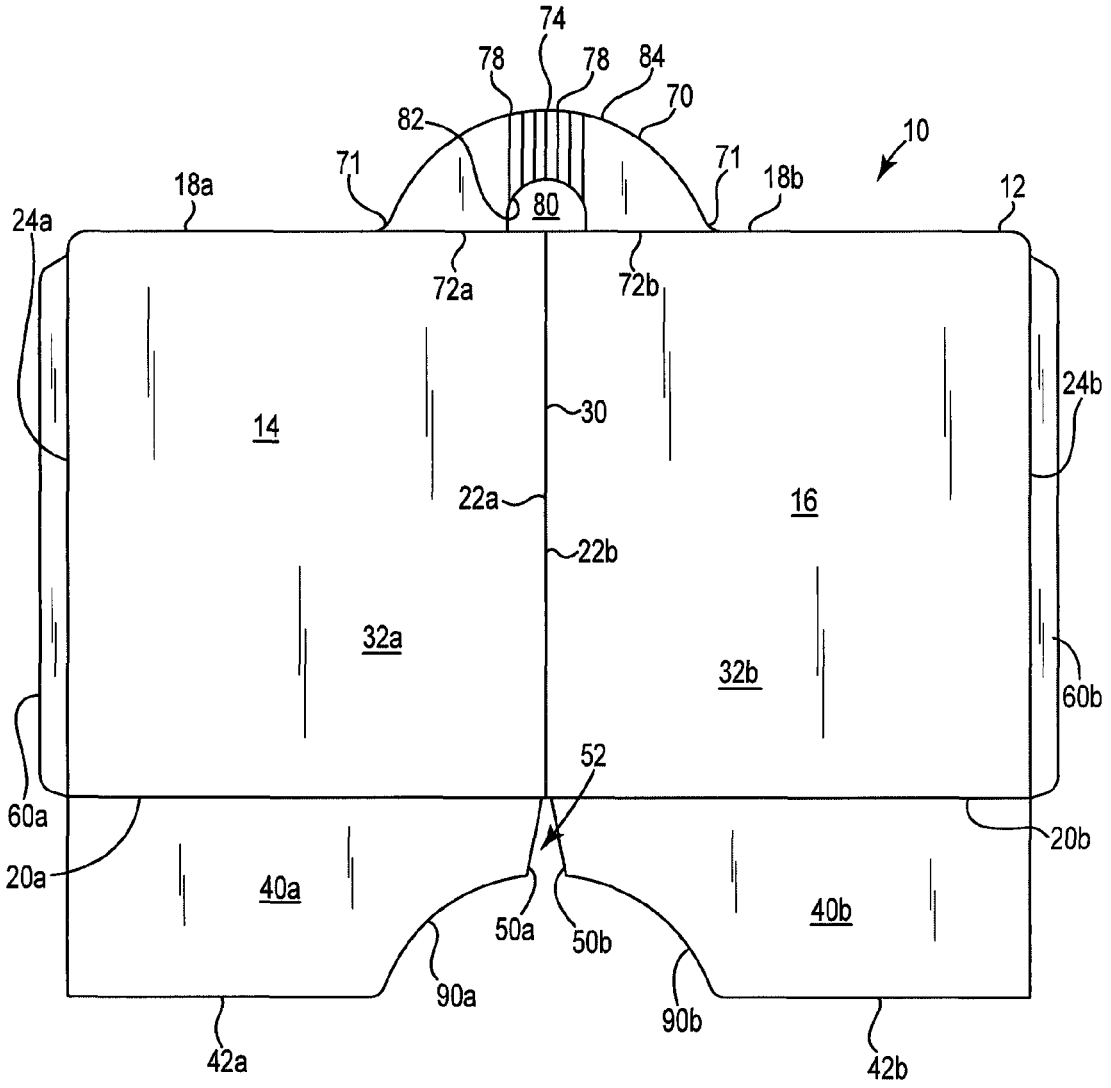
FIG. 1 illustrates a top plan view of a blank according to one embodiment.
Figure 2:
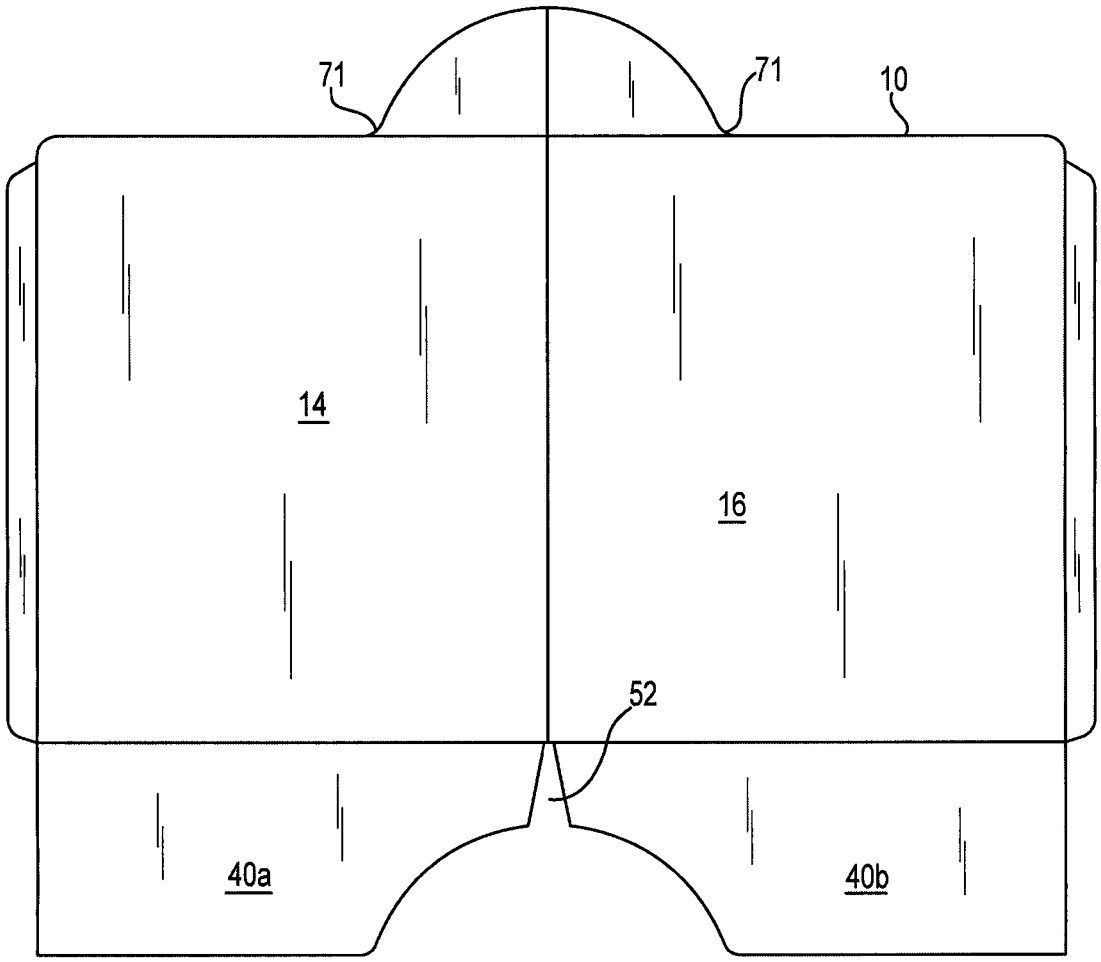
FIG. 2 illustrates a top plan view of a blank according to a second embodiment.

In the embodiment shown in FIG. 1 folder 10 is preferably made of single blank of materials, often a double or triple weight board material or synthetic such as plastic. In the method as described below, various cuts and folds are made in the blank to achieve the desired features.

Figure 5:
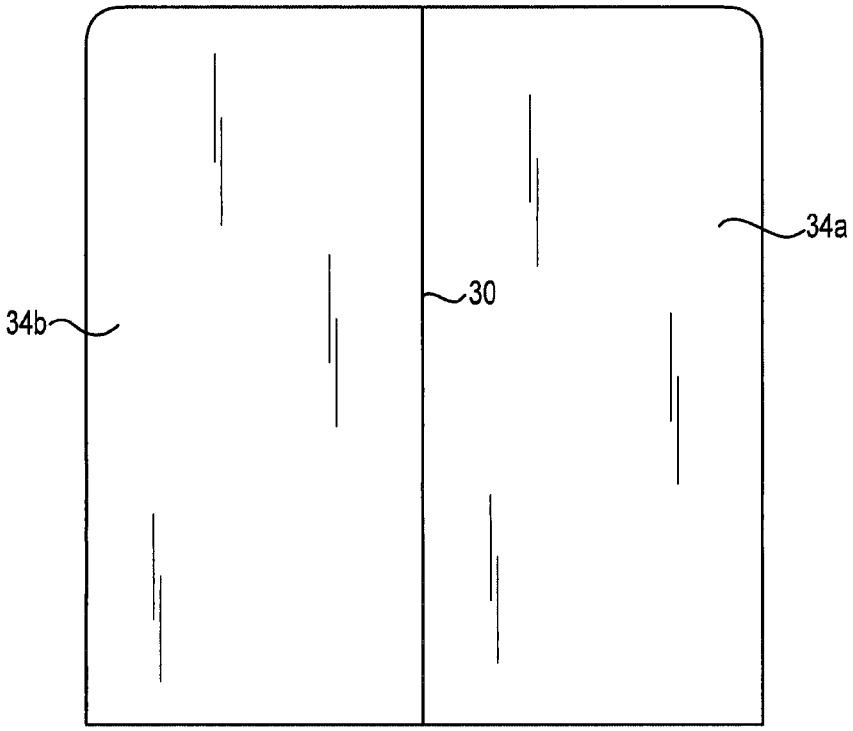
FIG. 5 illustrates a rear plan view of FIG. 3.
Figure 6:
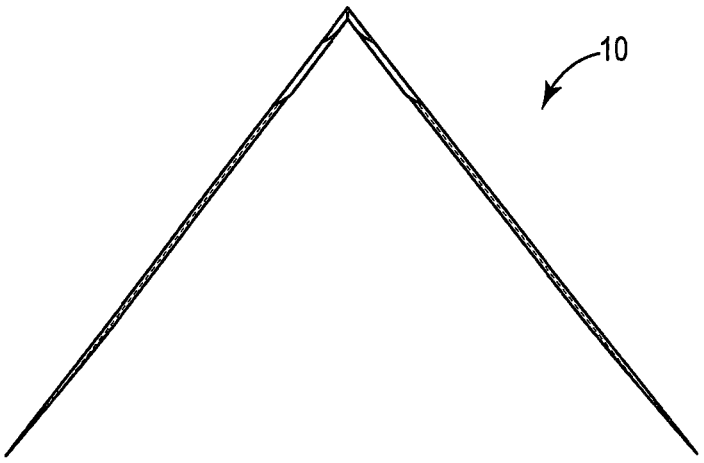
FIG. 6 illustrates a top plan view of FIG. 3.
Figure 7:
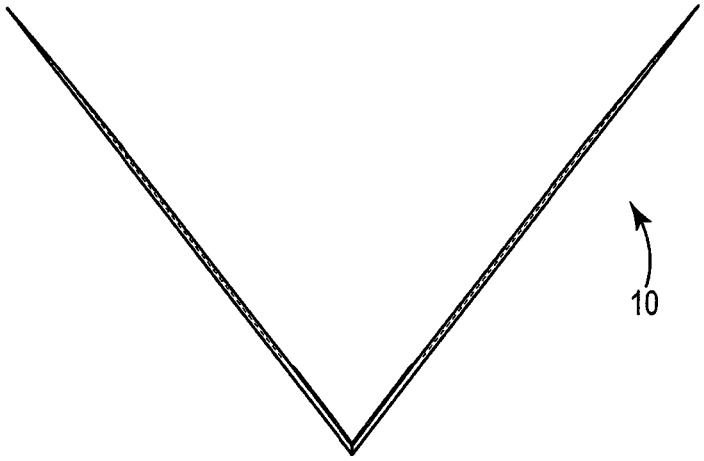
FIG. 7 illustrates a bottom plan view of FIG. 4.

The blank 12 is shown after cutting portions away as shown in FIG. 1. The blank includes a first cover 16 and a second cover 16 each having upper (18*a*-18*b*), bottom (20*a*-20*b*), inner (22*a*-22*b*) and outer (24*a*-24*b*) peripheral edges joined together along their inner edges at a joint 30 and defining a joint axis; each of said first cover and said second cover, each having an interior surface 32*a*-32*b* on the interior of the document holder and an outer surface 34*a*-34*b* on the exterior of the document holder (FIG. 5); a pair of pocket flaps 40*a*-40*b* formed of a pocket face attached to each of the covers at the bottom 20*a*-20*b* and outer edges 42*a*-42*b* and substantially unattached at what becomes upper edge 42*a*-42*b* after folding.

The pocket flaps 40*a*-40*b* have a side edge 50*a*-50*b* which includes a v-shaped notch 50 which is formed by the cutting away of a portion of the flap 40*a*-40*b* at an angle away from the fold line 30. The cut away at 50*a*-50*b* is preferably sufficient to prevent buckling of the pockets as they are filled with documents. The cut away on each flap is preferably 5 degrees off center line 30 or as shown making the v-notch roughly 10 degrees. Other possible cuts of the center line are for example, 5-10 degrees, 7.5-10 degrees, 10-15 degrees, 15-30 degrees. The cut away can also be at a greater angle to accommodate more documents, up to approximately 45 degrees when it begins to interfere with the functioning of the pocket itself by the removal of so much material.

To accomplish the objectives of the notch 52 and yet provide access to the documents, a further cut away is possible, where a circular portion 90*a*-90*b* is cut away from each pocket flap. In the preferred embodiment the cut away is circular and starts from the upper edge of the v-notch and extends into the flap toward its edge 42*a*-42*b*. The cut may also be a diagonal straight line from the top of the v-notch to end.

Edges 42*a*-42*b* or so other shape to expose as much of the document as possible without losing the integrity of the pocket.

The pocket flaps are also folded along a score line 20*a*-20*b* at a predetermined distance from the edges 42*a*-42*b* and side flaps 60*a*-60*b* are folded and bonded to the flaps along the edge score 24*a*-24*b*. Score lines are defined as depressions impressed into the material which compresses the material/fibers so that they bend/fold on a predictable path. The side flaps are a predetermined width extending from the edge 24*a*-24*b* but in fact are formed by cutting of the blank.

To assist in holding documents in the pockets, a top flap 70 is formed at top score line 72*a*-72*b* which runs along the top edge 18*a*-18*b*. At the intersection of flap 70 with the top edge, the flap is slightly radiused, ie the flap "flows" into the top edge so that there is no corners to provide a tear point and undue stress on the fibers of the material. Likewise, score line 72*a*-72*b* must preferably pass entirely through the intersection between the top tab and the top surfaces so that the material fibers are less likely to tear. In fact, the score line compresses the fibers and gives them additional strength at a high stress point.

Figure 3:
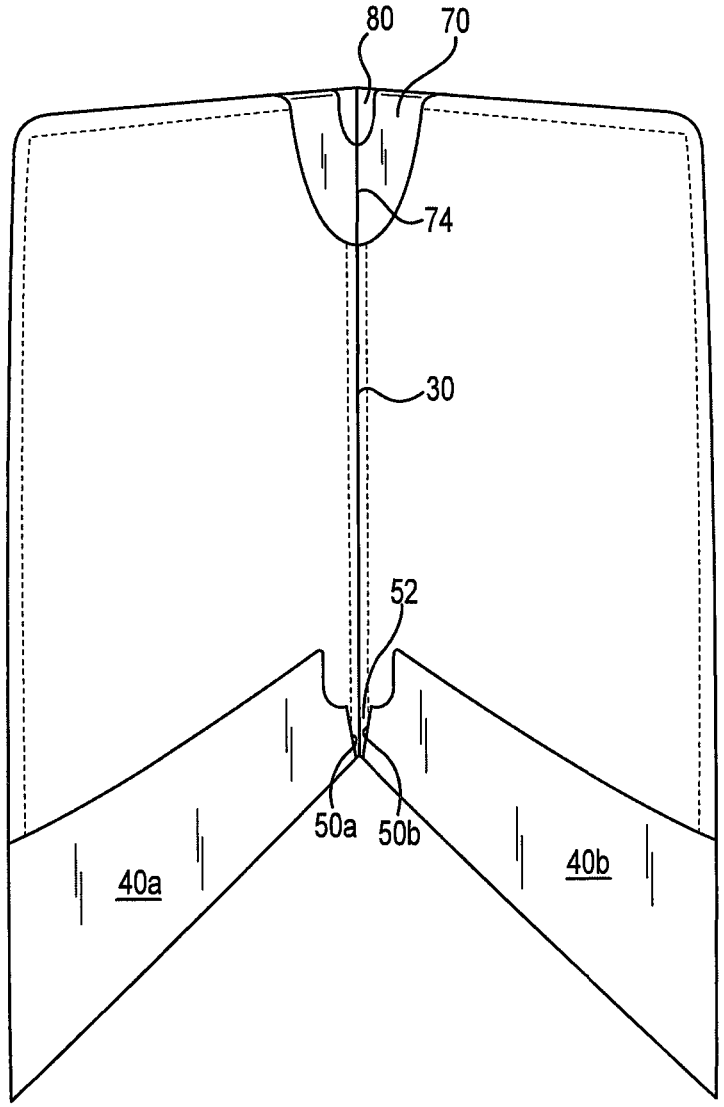
FIG. 3 illustrates a front perspective view of a pocket folder according to the first embodiment.
Figure 4:
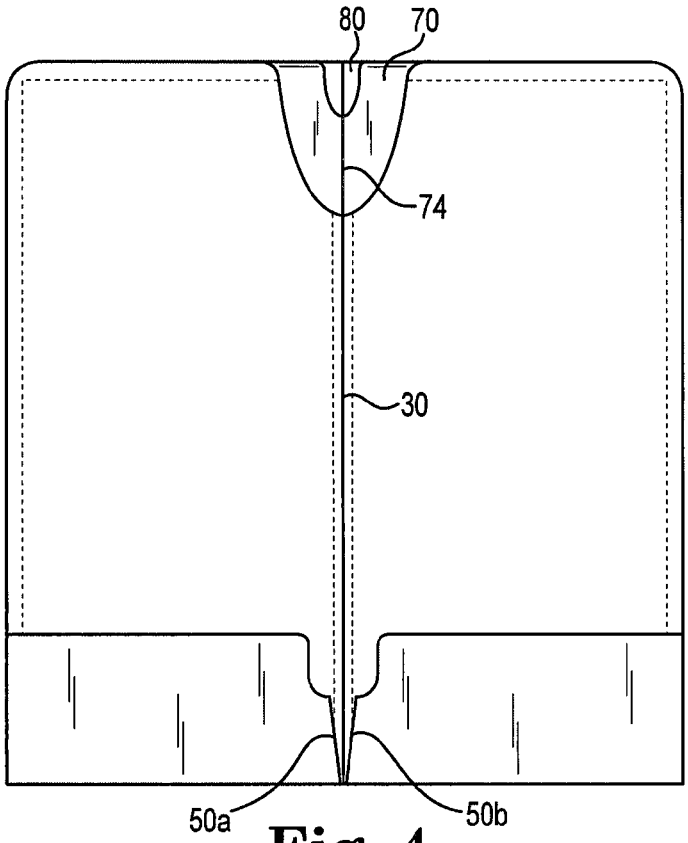
FIG. 4 illustrates a front plan view of FIG. 3.

Flap 70 also includes a main score line 74 which is co-axial with fold line 30 so that when the folder is folded, the top flap also folds symmetrically along line 74. Flap 70 is folded over as shown in FIG. 3 when in use. To accommodate documents of varying thicknesses, top flap 70 preferably includes a plurality of parallel spaced apart score lines 78 which assist the flap in bending to accommodate additional thicknesses without buckling.

Likewise, in one embodiment, a portion of the top flap 70 is cut away to reveal an aperture 80 which is bounded on one edge by the top edges 18*a*-18*b* and on the semicircular inner edge 82 of the tab. The inner edge 82 may be other shapes besides circular, such as a v-cut or diamond shaped. The outer edge 84 of the top tab is also shown as circular but it too may be other shapes such a triangular, v-shaped, rectangular, etc.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A method of minimizing waste in forming making a blank of web material into a plurality of pocket folders each having a pair of pockets on either side of a center fold line and having a retainer flap, comprising the steps of:

a. cutting and scoring a blank having left and right edges and left and right portions and upper and bottom edges and a central longitudinal score forming a center line defining left and right portions and a lateral score line orthogonal to the central longitudinal score line located a predetermined distance from the bottom of the blank defining a fold line to create left and right pockets;

b. defining a portion of the blank at its top edge orthogonal to the central score line, a semicircular protrusion foldable into a flap , and defining an upper longitudinal edge of the blank, excluding the protrusion;

c. scoring said blank along the upper edge to define a fold line between the protrusion and the upper edge;

d. cutting the blank into first and second identical blanks, each forming a separate folder, the cutting occurring along line parallel with the upper and bottom edged except adjacent the central fold line where the cut line follows a semicircle on either side of said fold line, thereby forming said flap protrusion on said top edge and a semicircular recess in said bottom edge, wherein said flap protrusion and said semicircular recess have identical curvatures, so that there is no waste material therebetween;

e. scoring a protrusion fold line in said flap protrusion, said protrusion fold line being co-axial with said blank fold line;

f. cutting a v-shaped notch into the bottom edge from at the central score line to said predetermined distance from the bottom-edge;

g. folding along the said blank along said lateral score line to form a pair of side by side pockets;

h. folding said protrusion along said protrusion flap fold line to create a top retaining flap;

i. cutting away a section of the blank on the left and right portions adjacent the bottom of the blank and side scoring the blank on the left and right portions longitudinally spaced a predetermined distance from the left and right edges;

j. folding said blank along said at said side scoring, and k. affixing said side scoring portions to said pockets.

2. A method of minimizing waste in forming making a blank of web material into a plurality of pocket folders each having a pair of pockets on either side of a center fold line and having a retainer flap, comprising the steps of:

a. cutting and scoring a blank having left and right edges and left and right portions and top and bottom edges and a central longitudinal score forming a center line defining left and right portions and a lateral score line orthogonal to the central longitudinal score line located a predetermined distance from the bottom of the blank defining a fold line to create left and right pockets;

b. defining a portion of the blank at its top edge orthogonal to the central score line, a semicircular protrusion foldable into a flap, and defining an top longitudinal edge of the blank, excluding the protrusion;

c. scoring said blank along the top edge to define a fold line between the protrusion and the top edge;

d. cutting the blank into first and second identical blanks, each forming a separate folder, the cutting occurring along line parallel with the top and bottom edged except adjacent the central fold line where the cut line follows a semicircle on either side of said fold line, thereby forming said flap protrusion on said top edge and a semicircular recess in said bottom edge, wherein said flap protrusion and said semicircular recess have identical curvatures, so that there is no waste material therebetween:

e. scoring a protrusion fold line in said flap protrusion, said protrusion fold line being co-axial with said blank fold line;

whereby successive folders may be cut from a continuous web of material, each folder having a retaining protrusion flap and an arcuate pocket wall having a semi-circular recess, with no waste material between successful folders cut from the web.

3. A method of minimizing waste in forming making a blank of web material into a plurality of pocket folders each having a pair of pockets on either side of a center fold line and having a retainer flap, comprising the steps of:

a. cutting and scoring a blank having left and right edges and left and right portions and top and bottom edges and a central longitudinal score forming a center line defining left and right portions and a lateral score line orthogonal to the central longitudinal score line located a predetermined distance from the bottom of the blank defining a fold line to create left and right pockets;

b. defining a portion of the blank at its top edge orthogonal to the central score line, a semicircular protrusion foldable into a flap, and defining an top longitudinal edge of the blank, excluding the protrusion;

c. scoring said blank along the top edge to define a fold line between the protrusion and the top edge;

d. cutting the blank into first and second identical blanks, each forming a separate folder, the cutting occurring along line parallel with the top and bottom edges except adjacent the central fold line where the cut line follows a non-linear path on either side of said fold line, thereby forming said flap protrusion on said top edge and a non-linear recess in said bottom edge, wherein said flap protrusion and said non-linear recess have identical non-linear shape, so that there is no waste material therebetween:

e. scoring a protrusion fold line in said flap protrusion, said protrusion fold line being co-axial with said blank fold line;

whereby successive folders may be cut from a continuous web of material , each folder having a retaining protrusion flap and a pocket wall having a non-linear recess, with no waste material between successful folders cut from the web.

* * * * *